US008727583B2

(12) United States Patent
Russo et al.

(10) Patent No.: US 8,727,583 B2
(45) Date of Patent: May 20, 2014

(54) LAMP ALIGNMENT ASSEMBLY AND LIGHTING DEVICE

(75) Inventors: Neil Russo, Jackson, NJ (US); Shailesh I. Naik, Dayton, NJ (US); Steven M. Silverstein, Woodcliff Lake, NJ (US)

(73) Assignee: Hubbell Incorporated, Shelton, CT (US)

( * ) Notice: Subject to any disclaimer, the term of this patent is extended or adjusted under 35 U.S.C. 154(b) by 761 days.

(21) Appl. No.: 12/347,324

(22) Filed: Dec. 31, 2008

(65) Prior Publication Data

US 2010/0165643 A1 Jul. 1, 2010

(51) Int. Cl.
*F21V 15/00* (2006.01)
*F21V 17/00* (2006.01)
*F21V 21/00* (2006.01)

(52) U.S. Cl.
USPC ..... 362/365; 362/364; 362/366; 362/372; 362/371

(58) Field of Classification Search
USPC ..... 362/364, 365, 366, 372
See application file for complete search history.

(56) References Cited

U.S. PATENT DOCUMENTS

| | | | | |
|---|---|---|---|---|
| 2,518,936 | A | 8/1950 | Roberts | |
| 2,898,075 | A | 8/1959 | McGinty | |
| 2,984,738 | A | 5/1961 | Belau | |
| 4,173,037 | A | 10/1979 | Henderson, Jr. et al. | |
| 4,881,157 | A | 11/1989 | Pahl | |
| 5,800,050 | A | 9/1998 | Leadford | |
| 5,951,151 | A | 9/1999 | Doubeck et al. | |
| 6,082,878 | A * | 7/2000 | Doubek et al. | 362/365 |
| 6,402,112 | B1 * | 6/2002 | Thomas et al. | 248/317 |
| 6,431,723 | B1 | 8/2002 | Schubert et al. | |
| 6,543,915 | B1 * | 4/2003 | Chen | 362/427 |
| 6,554,457 | B1 * | 4/2003 | Platt | 362/365 |
| 6,632,006 | B1 * | 10/2003 | Rippel et al. | 362/366 |
| 6,652,124 | B2 * | 11/2003 | Schubert et al. | 362/285 |
| 7,118,254 | B2 | 10/2006 | Czech | |
| 7,125,135 | B2 * | 10/2006 | Ward | 362/147 |
| 7,186,008 | B2 * | 3/2007 | Patti | 362/365 |
| 7,234,674 | B2 | 6/2007 | Rippel et al. | |
| 7,234,846 | B2 * | 6/2007 | Chen | 362/365 |
| 7,311,422 | B1 * | 12/2007 | Chen | 362/364 |
| 7,374,308 | B2 | 5/2008 | Sevack et al. | |
| 2003/0007354 | A1 * | 1/2003 | Schubert et al. | 362/285 |
| 2003/0161153 | A1 * | 8/2003 | Patti | 362/289 |

(Continued)

FOREIGN PATENT DOCUMENTS

| | | |
|---|---|---|
| GB | 2061703 | 5/1981 |

*Primary Examiner* — Jong-Suk (James) Lee
*Assistant Examiner* — Bryon T Gyllstrom
(74) *Attorney, Agent, or Firm* — Garrett V. Davis; Mark S. Bicks; Alfred N. Goodman

(57) ABSTRACT

A lighting assembly includes a lamp alignment assembly for positioning the lamps after the lighting assembly is installed. The lighting assembly includes a ceiling pan for mounting to the ceiling support and a lamp assembly attached to the ceiling pan. The lamp assembly is adjustable in a transverse and rotational direction with respect to the ceiling pan. A stop member on the ceiling pan is received in an aperture in the lamp assembly to limit movement of the lamp assembly on the base. The lamp assembly is provided with alignment springs to align the lamp assembly at predetermined settings. A sight window is formed in the ceiling to visually set the lamp assembly in a selected position. A locking member on the lamp assembly locks the lamp assembly in a fixed position on the ceiling pan.

22 Claims, 9 Drawing Sheets

(56) References Cited

U.S. PATENT DOCUMENTS

| | | | | |
|---|---|---|---|---|
| 2006/0087835 | A1* | 4/2006 | Sevack et al. | 362/147 |
| 2006/0193142 | A1 | 8/2006 | Dupre | |
| 2006/0261235 | A1 | 11/2006 | Rippel et al. | |
| 2007/0019418 | A1* | 1/2007 | Czech et al. | 362/364 |
| 2007/0075206 | A1 | 4/2007 | Wright et al. | |
| 2008/0025031 | A1 | 1/2008 | Wronski et al. | |
| 2008/0062693 | A1 | 3/2008 | Czech et al. | |
| 2008/0062705 | A1 | 3/2008 | Czech et al. | |
| 2008/0186717 | A1 | 8/2008 | Ruberg | |
| 2008/0186718 | A1 | 8/2008 | Magisano et al. | |

* cited by examiner

LAMP ALIGNMENT ASSEMBLY AND LIGHTING DEVICE

CROSS-REFERENCE TO RELATED APPLICATIONS

This application is related to U.S. application Ser. No. 12/347,253, filed Dec. 31, 2008 to Russo et al. entitled "Lighting Assembly and Lamp Aiming Device", and U.S. application Ser. No. 12/347,296, filed Dec. 31, 2008 to Russo et al. entitled "Lighting Assembly with Aperture Alignment Assembly", which are hereby incorporated by reference in their entirety.

FIELD OF THE INVENTION

The present invention is directed to a lamp alignment assembly having an adjustable assembly for positioning the lamp assembly and for adjusting the direction of the light to a target area. More particularly, the invention is directed to an adjustable light assembly with an adjustable assembly such that the lamp can be adjusted in a selected angular and rotational orientation.

BACKGROUND OF THE INVENTION

Recess lighting fixtures are commonly used in construction. The recess lighting fixtures generally include a base or plaster frame, a lamp holder for holding the electrical lamp and a trim ring. Recessed lighting fixtures provide lighting characteristics that are often desired in new construction and in existing ceilings.

Recessed lighting fixtures are fixed to the ceiling in a specific location and the location of the lighting fixture is often limited by the ceiling structure. Many recessed lighting fixtures have fixed lamps that do not permit adjustment. Depending on the location of the recessed lighting fixture, it may be desirable to aim the lamp in a particular direction to provide the desired lighting pattern or to focus the light in a specific target area. The adjustment mechanisms of many of the prior recessed lighting fixtures are difficult to operate and provide limited orientation of the lamp. The confined area of the recessed lighting fixture also makes it difficult to adjust the position of the lamp after the fixture is installed in the ceiling.

Various devices have been proposed for recessed lighting fixtures and downlights having an adjustment mechanism to enable the adjustment and orientation of the lamp. One example is disclosed in U.S. Published Patent Application No. 2006/0193142 to Dupre. The adjustment device in this published application includes a worm gear drive for aiming a locking mechanism for a luminaire. The luminaire assembly includes a collar and a yoke where the yoke is pivotally connected to the collar. A worm gear is attached to the collar and engages gear teeth on an arm to pivot the yoke with respect to the collar. The collar has an inner collar which rotates axially with respect to the outer collar about a vertical axis. In this manner, the luminaire can pivot about a vertical axis and about a horizontal axis.

U.S. Patent Publication Nos. 2008/0062693 and 2008/0062705 to Czech et al. are directed to a rotatable lamp with a braking mechanism. The mechanism has a rotation ring that is held in place by a ring clamp that is rotatable on a frame. A mechanical brake is provided for locking the ring in place.

U.S. Patent Publication 2008/0186717 to Ruberg relates to a compact luminaire having a lamp module bracket assembly. The assembly has a first band and a second band connected together by a pair of arms. The arms are pivotally connected to the band to allow aiming of the luminaire. A screw is tightened to fix the position of the lamp of the luminaire.

U.S. Pat. No. 5,951,151 to Doubeck et al. discloses a lamp assembly for recessed ceiling fixture having a support assembly for a lamp socket and a lamp. The support assembly has a rotation ring to allow rotation about a vertical axis with respect to the frame. The support assembly also includes arms that are pivotally connected to the rotation ring to allow angular adjustment of the lamp about a horizontal axis.

U.S. Pat. No. 6,082,878 to Doubeck et al. discloses a rotatable recessed light fixture with a movable stop member. A spin disk has an upwardly extending tab which engages a stop member upon rotation of the spin disk. The lamp mechanism is able to rotate with the spin disk about a vertical axis. A lamp support also includes a support member for the lamp where the support member is pivotally connected to the lamp mechanism. The support member has a pair of legs with projections which slide within an arcuate slot formed in a bracket that is fixed to the ring. The legs enable the lamp mechanism to pivot about a horizontal axis and a vertical axis with respect to the frame.

U.S. Pat. No. 6,652,124 to Schubert et al. relates to an adjustable light fixture having a rotation adjustment assembly and an angle adjustment assembly for directing a lamp to a target area. The light fixture includes a frame having an aperture and a mounting disk. The mounting disk includes arms which form an angle adjustment assembly for the lamp. A rotation assembly is pivotally connected to the arms and the angle adjustment assembly. The rotation assembly includes a rotation disk and a rotation frame which holds the lamp. The position of the lamp can be adjusted about a horizontal axis and a vertical axis by rotating the rotation assembly with respect to the arms and the mounting disk.

Other adjustable lamp assemblies are disclosed in U.S. Patent Publication No. 2008/0186718 to Magisano et al., U.S. Pat. No. 4,173,073 to Henderson, Jr. et al., U.S. Pat. No. 4,881,157 to Pahl and GB 2,061,703 to Gilbert.

Although the prior devices function in the intended manner, these devices are relatively complicated and can be difficult to adjust the position of the lamp in some situations. Therefore, there is a continuing need in the industry for improved adjustment mechanisms for lamp assemblies.

SUMMARY OF THE INVENTION

The present invention is directed to an alignment assembly for a lighting fixture that can be used for ceiling-mounted assemblies or recessed lighting assemblies. The invention is particularly directed to an adjustable lighting assembly where the lamp can be aligned with an opening in the lighting assembly where the lamp is movable in two dimensions with respect to the lighting assembly.

The light assembly of the invention includes a ceiling pan and a lamp assembly where the position of the lamp assembly is adjustable with respect to the opening in the ceiling pan. The lamp assembly includes a lamp holder and lamp which can be rotated about a vertical axis and adjusted about a horizontal axis independent of the adjustment about the vertical axis. The alignment assembly enables a transverse alignment of the lamp assembly independent of the angular adjustment. The adjustable light assembly of the invention can include a single lamp holder and lamp or a plurality of lamp holders and lamps where each lamp can be adjusted independently of the other.

One aspect of the invention is to provide an adjustable light assembly that is easy to construct and install by the technician. In one embodiment of the invention, the lamp assembly is adjustable after the ceiling pan is mounted to the ceiling support. The lamp assembly can be adjusted easily by rotating about a vertical axis with respect to the ceiling pan and the lamp can be rotated about a vertical axis and about a horizontal axis with respect to the lamp assembly after the light assembly is installed and mounted in a ceiling.

Another aspect of the invention is to provide a lamp alignment assembly having a locking member that is able to fix the position of the lamp assembly with respect to the ceiling pan. The locking member is attached to the lamp assembly in one embodiment and engages the ceiling pan to prevent rotation and transverse movement of the lamp assembly on the ceiling pan.

The various aspects of the invention are obtained by providing a light assembly comprising a ceiling pan adapted for attaching to a ceiling. The ceiling pan has an opening for directing light in a downward direction. A lamp assembly is mounted on the ceiling pan and has a base and a lamp for directing light in a substantially downward direction through the opening in the ceiling pan. The base is coupled to the pan for limited rotational movement about a vertical axis with respect to the ceiling pan and for limited transverse movement with respect to the pan.

The aspects of the invention are also obtained by providing a lighting assembly comprising a ceiling pan for coupling to a support. The ceiling pan has a substantially planar bottom wall and an opening extending therethrough. At least one hold down member is on a top surface of the ceiling pan. A lamp assembly has a base secured to the ceiling pan by the at least one hold down member. The base has an opening aligned with the opening in the pan. A lamp is coupled to the base for directing light downwardly through the opening in the ceiling pan and the base of the lamp assembly. The lamp assembly is rotatably and transversely movable with respect to the ceiling pan. A stop assembly limits rotational and transverse movement of the lamp assembly with respect to the ceiling pan.

The aspects of the invention are also obtained by providing a lighting assembly comprising a ceiling pan having a top surface, a bottom surface, and a centrally located opening for directing light in a substantially downward direction. A lamp assembly is on the top surface of the ceiling pan. The lamp assembly has a base contacting the top surface of the ceiling pan. A lamp assembly is coupled to the base. A locking assembly locks the lamp assembly in a fixed position with respect to the pan.

These and other aspects of the invention will become apparent from the following detailed description of the invention and the annexed drawings which disclose various embodiments of the invention.

BRIEF DESCRIPTION OF THE DRAWINGS

The following is a brief description of the drawings in which.

DETAILED DESCRIPTION OF THE INVENTION

Figure 1:
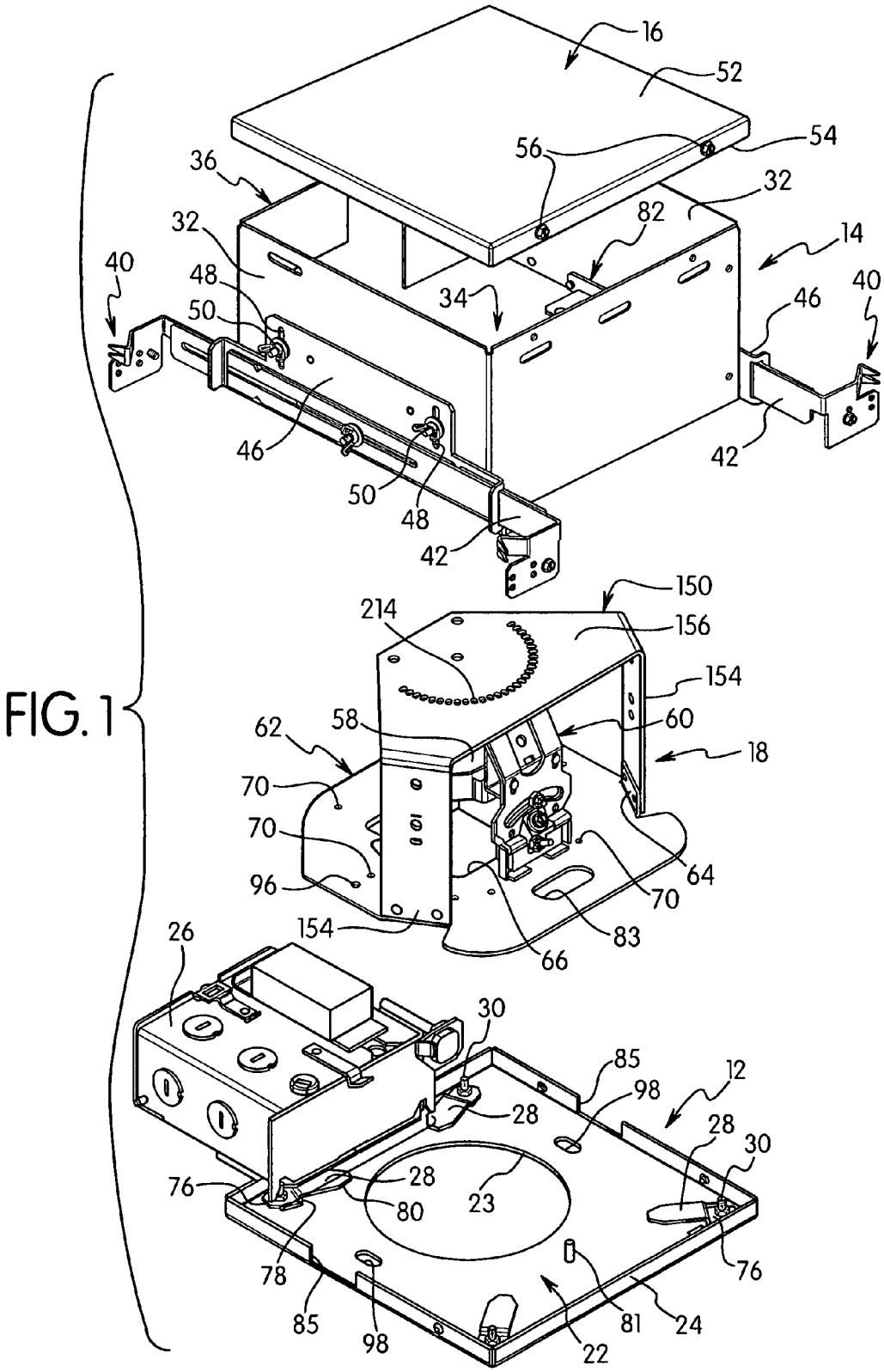
FIG. 1 is a perspective view of one embodiment of the adjustable light assembly of the invention.

The present invention is directed to an alignment assembly for a light assembly having a ceiling pan and a lamp assembly. The invention is particularly directed to a light assembly where the position of the lamp assembly can be adjusted in a transverse direction with respect to the ceiling pan.

Referring to the drawings, the luminaire and light assembly 10 of the invention includes a ceiling pan 12 having a housing 14 with a cover 16 closing the top end of the housing 14. A lamp assembly 18 having a lamp support and aiming assembly is attached to ceiling pan 12.

Referring to FIG. 1, ceiling pan 12 is constructed for mounted in a ceiling in a conventional manner. Ceiling pan 12 has a flat bottom wall 22 with an upwardly extending peripheral flange 24. An electrical box 26 is mounted to flange 24 for enclosing electrical wiring components for the assembly in a conventional manner. Bottom wall 22 has an aperture defining a central opening 23 below light assembly 18 for directing light to the target site. Hold down brackets 28 are provided for coupling lamp assembly 18 to ceiling pan 12. In the embodiment illustrated, hold down brackets 28 are attached to bottom wall 20 by screws 30 or other fasteners. Hold down brackets 28 have a substantially L shape and overlie the top surface of lamp assembly 18 to allow axial rotation and limited lateral movement of light assembly 18 with respect to ceiling pan 12. Hold down brackets 28 allow the alignment and positioning of lamp assembly 18 with respect to opening 23 of ceiling pan 12. Hold down brackets 28 allow the alignment and positioning of lamp assembly 18 with respect to opening 23 of ceiling pan 12. In use, a trim ring and diffuser (not shown) are attached to the bottom side of light assembly 10.

Housing 14 has a side wall 32 with an open bottom 34 and an open top 36. Side walls 32 of housing 14 are coupled to flange 24 of ceiling pan 12 by screws or other fasteners.

Electrical box 26 is coupled to side wall 32 containing electrical components for light assembly 18.

Adjustable mounting hanger bars 40 are attached to opposite side walls 32 of housing 14. Mounting bars 40 include extending bars 42 having mounting tabs 44 for mounting to ceiling joists or other support structure. Mounting bars 42 are mounted to a mounting bracket 46 for sliding movement. Mounting bracket 46 includes slots 48 for receiving adjusting screws 50. Slots 48 allow vertical adjustment of mounting bars 40 with respect to housing 14 so that housing 14 and ceiling pan 12 can be vertically adjusted after mounting bars 40 are attached to a ceiling joist or other support. Adjusting screws 50 are tightened to fix the position of housing 14 with respect to hanger bar 42.

Cover 16 includes top wall 52 having a downwardly extending flange 54. Flange 54 is coupled to side wall 32 of housing 14 by screws 56 to enclose lamp assembly 18.

Figure 2:
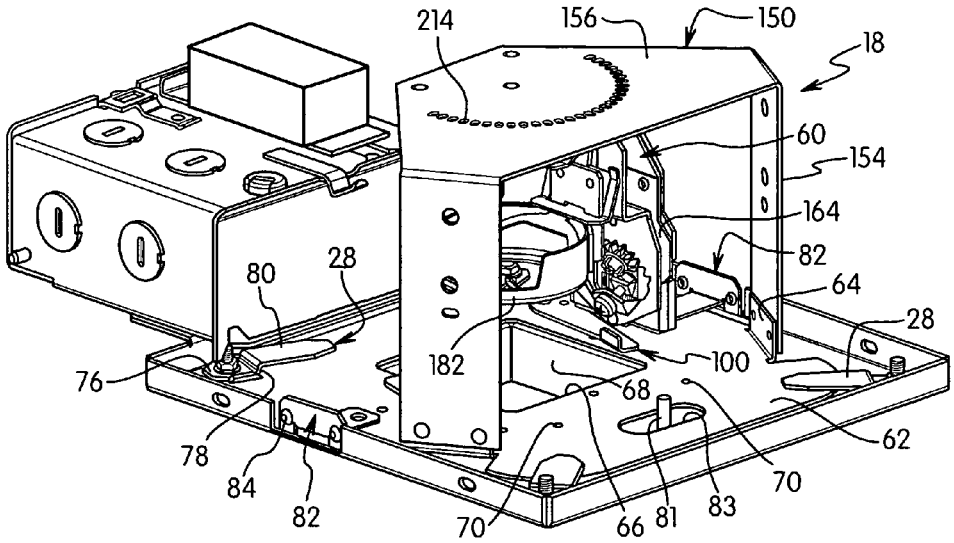
FIG. 2 is a perspective view of the light assembly of FIG. 1 showing the ceiling pan and lamp assembly without the housing.

In the embodiment of FIG. 1, lamp assembly 18 includes a single lamp 58 mounted to a lamp support 60. The lamp support 60 is adjustable to direct light to a selected area. In other embodiments, lamp assembly 18 can have two or more lamps. Referring to FIGS. 1 and 2, lamp assembly 18 includes a base 62 with brackets 64. Base 62 in the embodiment illustrated is substantially flat with a dimension to fit within flanges 24 of ceiling pan 12. Base 62 has a central opening 66 and a sleeve 68 extending downwardly from a bottom side of base 62. Sleeve 68 extends from the peripheral edge of central opening 66 for directing light from lamp 58 to the target area. In the embodiment shown, sleeve 68 extends through the opening in bottom wall 24 of ceiling pan 12.

Base 62 as shown has a square configuration with rounded corners to fit within the flange 24 of ceiling pan 12 to allow rotatable and lateral adjustment of lamp assembly 18 on ceiling pan 12. The shape of base 62 can vary provided that the shape and dimensions are sufficient to support lamp assembly 18 on ceiling pan 12 and to allow adjustment of the position of lamp assembly 18. In the embodiment of FIG. 2, sleeve 68 has a substantially square configuration corresponding to the lamp support 60 and lamp 58. In other embodiments, sleeve 68 can have other shapes and dimensions corresponding to the desired lighting pattern. Sleeve 68 extends through the opening 23 in ceiling pan 12 and has a dimension less than the dimension of opening 23 in ceiling pan 12 to allow rotational and lateral movement of light assembly 18 with respect to ceiling pan 12.

Base 62 preferably includes a plurality of spaced apart embossed dimples 70 extending downwardly to provide glide members between light assembly 18 and the bottom wall 22 of ceiling pan 12. Dimples 70 are formed by pressing or punching from the base 62 in a downward direction and have a height to space the bottom surface of bottom wall 22 from the top surface of ceiling pan 12 to limit contact and reduce friction between base 62 and ceiling pan 12. Dimples 70 have an outer end with a surface area sufficient to support lamp assembly 18 while reducing friction between lamp assembly 18 and ceiling pan 12. The dimples 70 are preferably spaced apart around the central opening in the base of lamp assembly 18 and are positioned to adequately support the lamp assembly. The number of dimples depend on the size and dimension of lamp assembly 12. In the embodiment illustrated, eight dimples are provided and are positioned to contact the ceiling pan radially outward from the central opening 23 in the ceiling pan 12.

Hold down brackets 28 are spaced apart a distance to attach base 62 of lamp assembly 18 to ceiling pan 12. As shown in FIGS. 1, 2 and 8-10, hold down brackets have a base 76 coupled to ceiling pan 12 by screws 30, an upwardly extending portion 78 and leg 80. Leg 80 is spaced from ceiling pan 12 a distance sufficient to capture base 62 of lamp assembly 18. Hold down brackets 28 are positioned so that the upward extending portion 78 is spaced to allow limited transverse and rotational movement of lamp assembly 18 with respect to ceiling pan 12. In the embodiment illustrated, four hold down brackets are provided although the number and spacing can vary depending on the design and dimensions of the light assembly 10.

Lamp assembly 18 includes a stop assembly to limit rotation of lamp assembly 18 with respect to ceiling pan 12 to enable the angular position of lamp assembly 18 to be adjusted and positioned for directing light to a selected area. Referring to FIGS. 1 and 2, the stop assembly includes a stop member 81 coupled to ceiling pan 12 which engages lamp assembly 18 to limit rotational adjustment and transverse adjustment of lamp assembly 18 with respect to ceiling pan 12. In one preferred embodiment, stop member 81 is a pin fixed to the top surface of bottom wall 22 of ceiling pan 12 and extends in an upward direction substantially perpendicular to the plane of ceiling pan 12.

Figure 5:
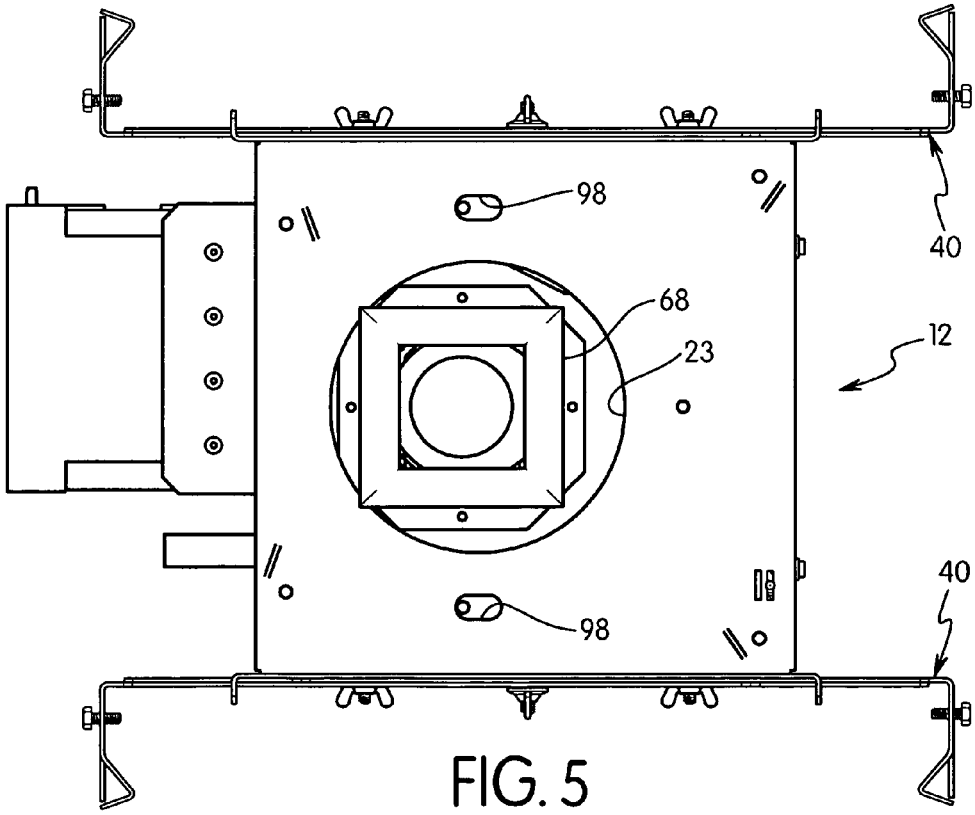
FIG. 5 is a bottom view of the lighting assembly of FIG. 1 showing the lamp assembly aligned off-center with respect to the opening in the ceiling pan.

As shown in FIG. 2, base 62 of lamp assembly 18 has an alignment aperture 83 for receiving stop member 81. Alignment aperture 83 has a dimension greater than the outer diameter of stop member 81. Alignment aperture 83 has a dimension to enable base 62 of lamp assembly 18 to rotate about the axis of central opening 23 in the ceiling pan and to allow some lateral or transverse movement with respect to the ceiling pan. The dimension and shape of the alignment aperture determines the amount of rotation and lateral adjustment of the ceiling pan. In the embodiment shown, alignment aperture 83 has an elongated shape having a longitudinal dimension extending substantially parallel to the side edge of base 62. Alignment aperture 83 and stop member 81 have dimensions in one embodiment of the invention to allow lateral movement of base 62 with respect to the ceiling pan in all directions a distance of at least about ¼ inch from the center of alignment aperture 83 as shown in FIG. 5. Alignment aperture 83 preferably has a longitudinal length to allow rotation of the lamp assembly of up to about 10° in either direction with respect to the axis of central opening 23 of ceiling pan 12.

Figure 3:
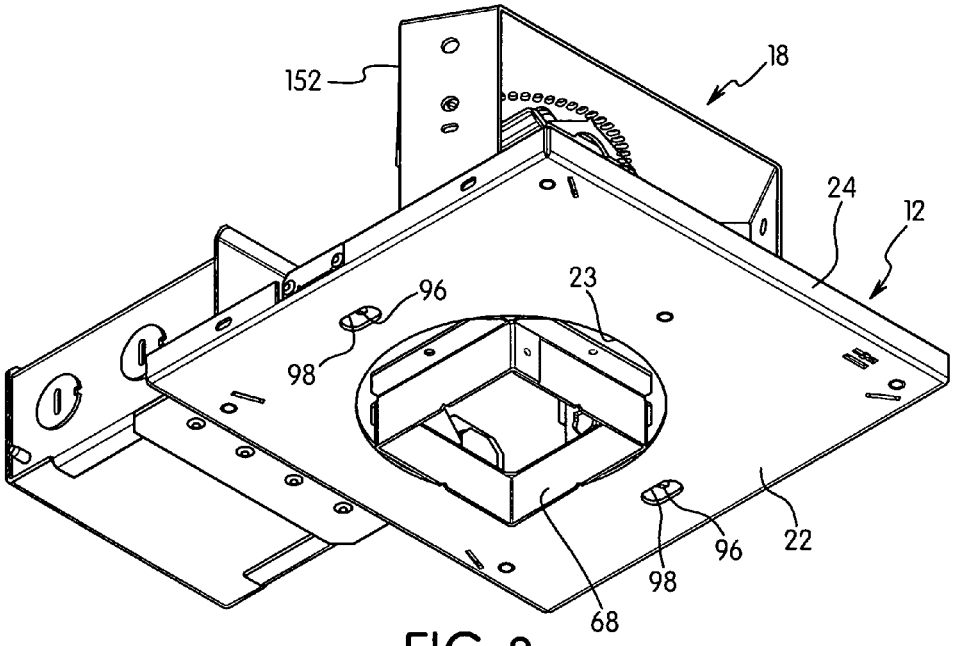
FIG. 3 is a bottom perspective view of the lighting assembly of FIG. 2.
Figure 8:
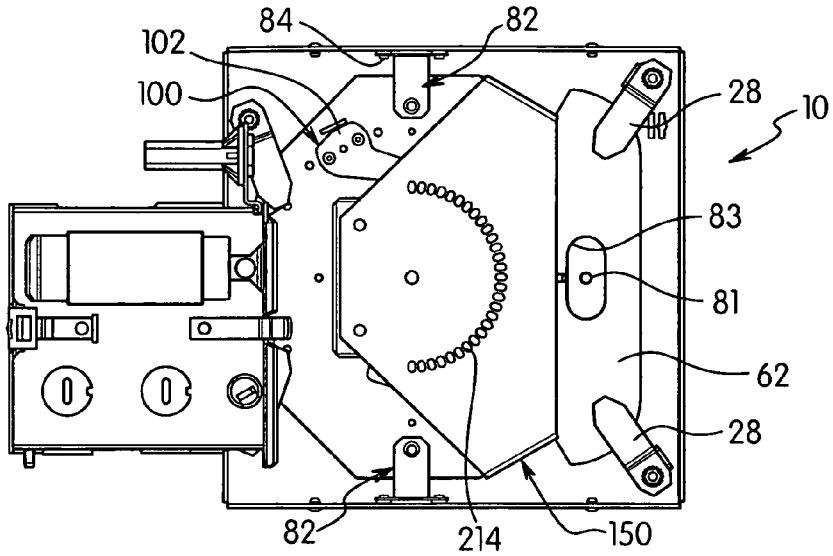
FIG. 8 is a top view of the lighting assembly in a centered position.
Figure 9:
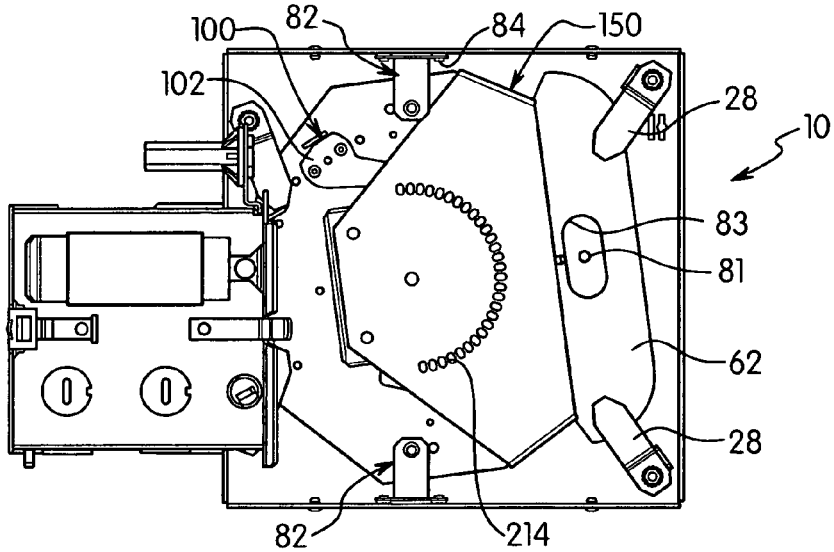
FIG. 9 is a top view of the lighting assembly showing the lamp assembly rotated in a counter-clockwise direction.
Figure 10:
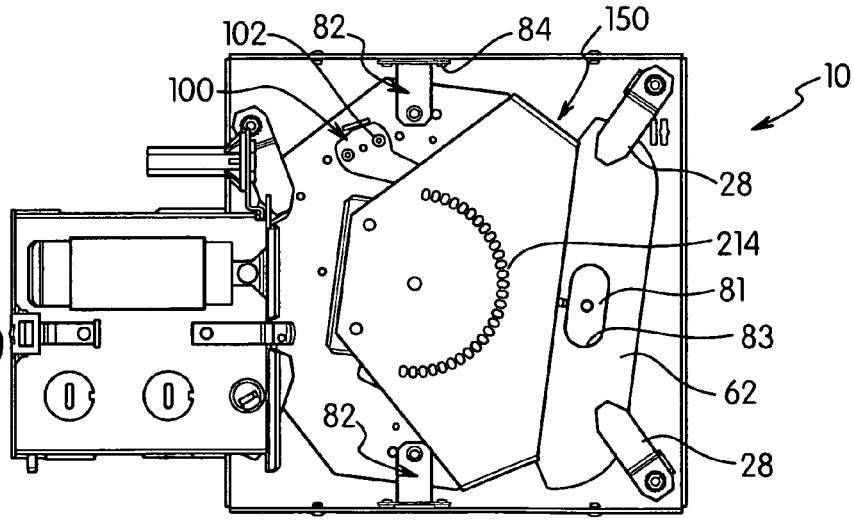
FIG. 10 is a top view of the lighting assembly showing the lamp assembly rotated in a clockwise direction.
Figure 11:
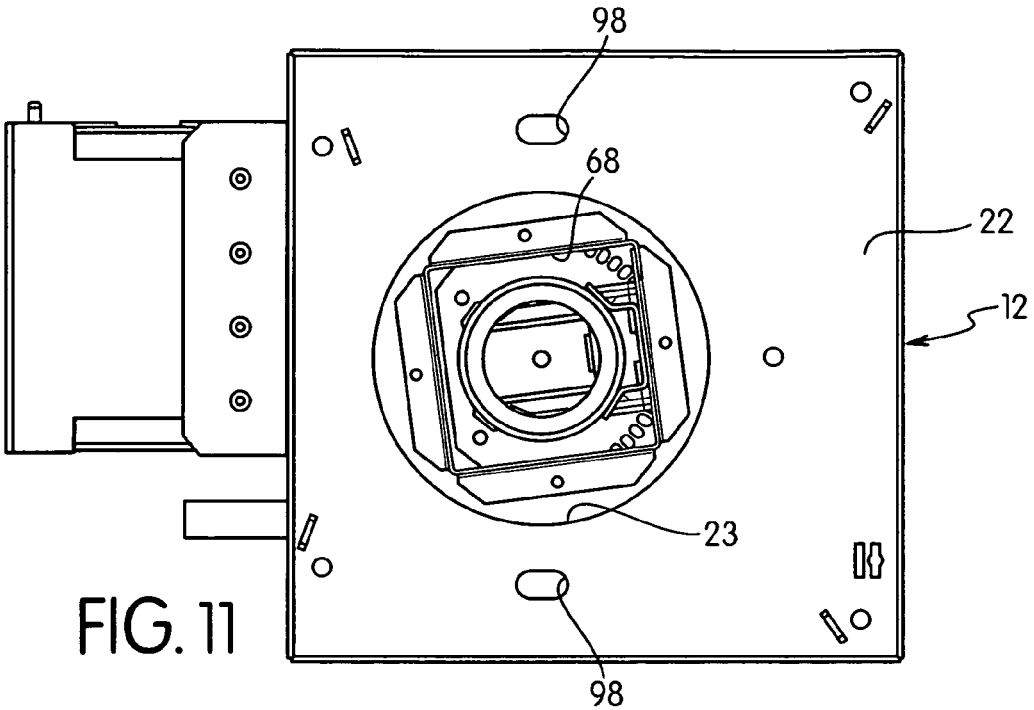
FIG. 11 is a bottom view of the lamp assembly of FIG. 10.

As shown in FIGS. 8-11, the position of lamp assembly 18 is adjustable with respect to ceiling pan 12 to align the sleeve and opening of ceiling pan 12 with the central opening of ceiling pan 12. FIG. 8 shows a centered position of ceiling pan 12 where stop member 81 is substantially centered within alignment opening 83. In the position of FIG. 8, the sleeve and opening of lamp assembly 18 is substantially centered in central opening 23 of ceiling pan 12 as shown in FIG. 3. FIG. 9 shows lamp assembly 18 rotated in a counter-clockwise direction about 10°, while FIGS. 10 and 11 show lamp assembly 18 rotated about 10° in a clockwise direction with respect to ceiling pan 12.

Referring to FIGS. 3 and 5, sleeve 68 has a dimension less than the dimension of the central opening of ceiling pan 12. Hold down brackets 28 are spaced a distance to enable base 62 to be adjusted in a transverse direction within the limits of alignment aperture 83. FIG. 5 shows lamp assembly 12 and the sleeve adjust laterally about ¼ inch with no rotation of lamp assembly 18 from the original position of FIG. 1. Sleeve 68 has a dimension smaller than the dimension of the central opening in ceiling pan 12 so that sleeve 68 and base 62 can be adjusted in a transverse direction with respect to ceiling pan 12. In one embodiment of the invention, the dimension of the sleeve 68, the dimension of the central opening in the ceiling pan and the spacing of the hold down brackets allow movement and lateral positioning of lamp assembly 18 of about ¼ inch in all directions. In this manner, lamp assembly 18 can be moved to position sleeve 68 at any location and at any angular orientation with respect to the central opening in ceiling pan 12.

Figure 14:
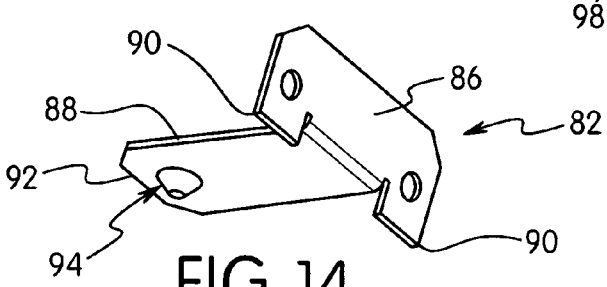
FIG. 14 is a bottom perspective view of the locator spring.

Light assembly 10 in one embodiment includes an alignment mechanism to position lamp assembly 18 at one or more predetermined positions with respect to ceiling pan 12. The alignment mechanism includes an alignment spring 82 which contacts base 62 of lamp assembly 18 to hold lamp assembly 18 in a selected position. Spring 82 in one embodiment is coupled to side wall 34 of housing 22 as shown in FIG. 1. As shown in FIG. 2, two springs 82 are attached to opposite sides of housing 22 by fasteners 84 such as rivets or screws. Ceiling pan 12 has a notch portion 85 cut from the flange to receive the springs 82 when housing 20 is assembled onto ceiling pan 12. FIGS. 2 and 3 show springs 82 in the assembled position on ceiling pan 12 without showing the housing for purposes of convenience. Spring 82 has a base 86 for attachment to the housing. A leg 88 is cut from base 86 as shown in FIG. 14 to form a pair of tabs 90 which contact the top surface of ceiling pan 12. Tabs 90 preferably have a height to position leg 88 to continuously contact the top surface of base 62 of lamp assembly 18. In the embodiment illustrated, alignment springs 82 are attached to housing 14 so that when housing 14 is fitted onto ceiling pan 12, alignment springs overlie base 62 of lamp assembly 18. In alternative embodiments, alignment springs 82 can be attached directly to flange 24 of ceiling pan 18.

Figure 12:
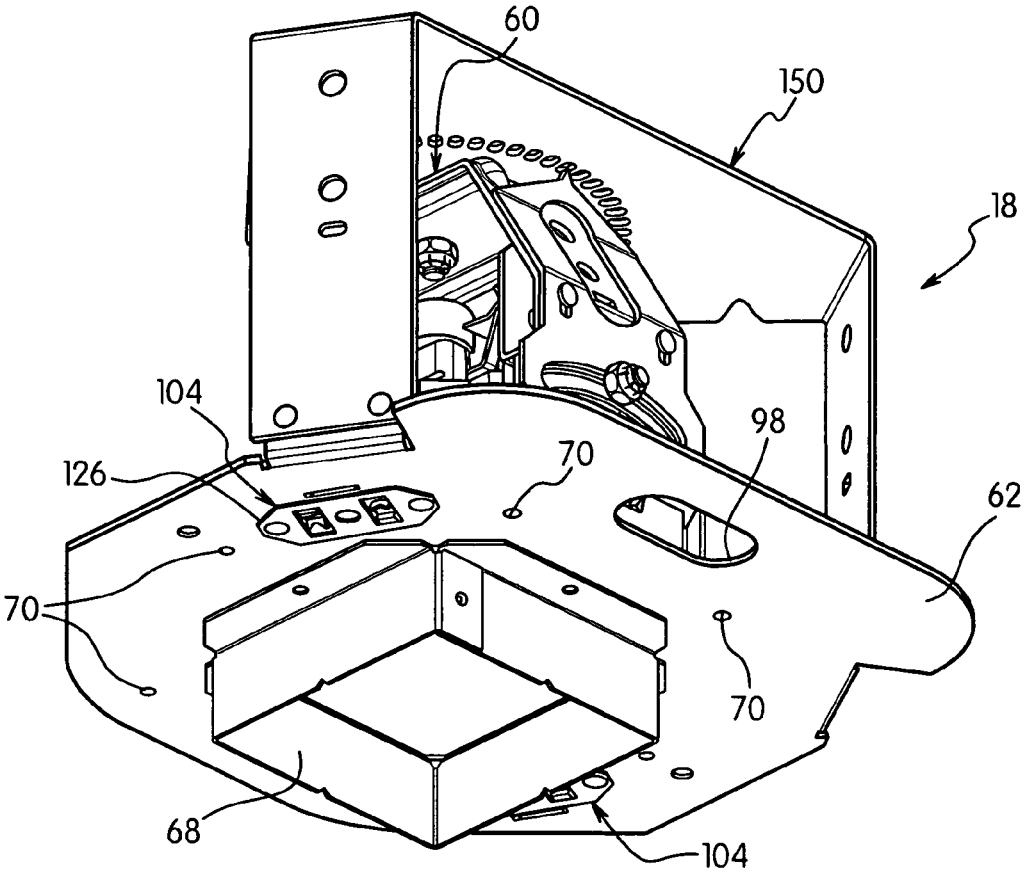
FIG. 12 is a bottom perspective view of the lamp assembly.
Figure 13:
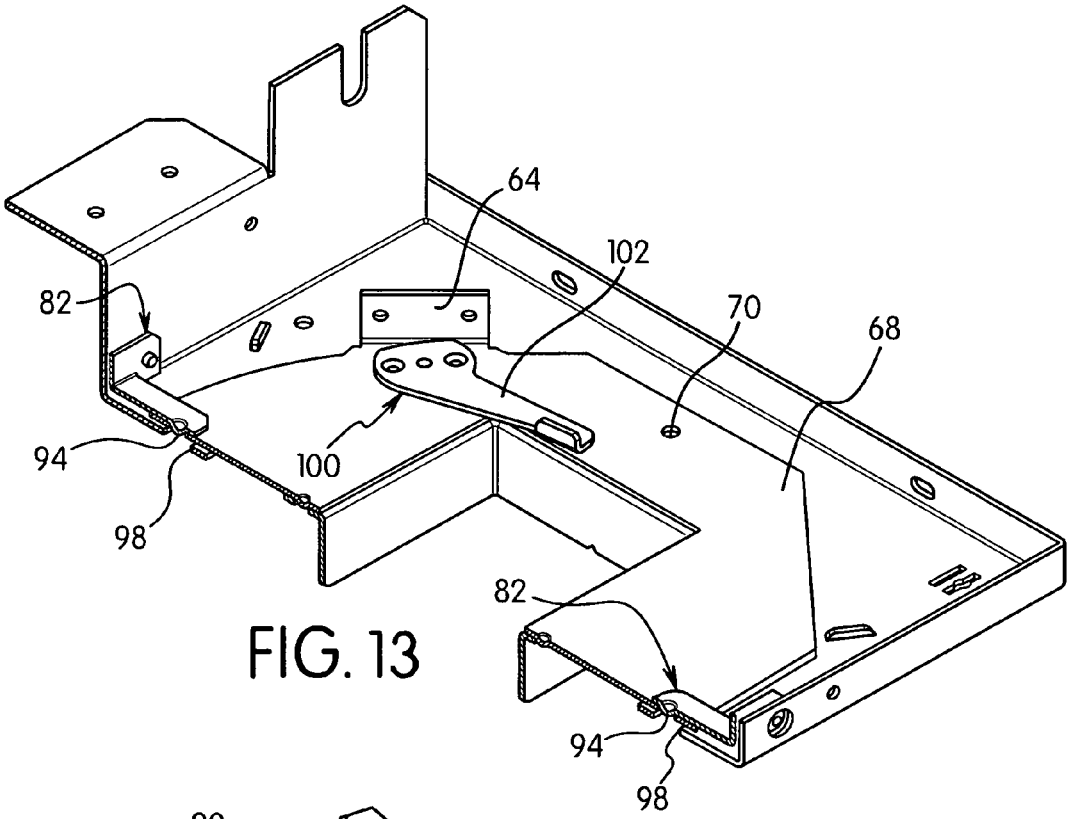
FIG. 13 is a cross-sectional view of the lighting assembly showing the locator spring and locking member.

Leg 88 has a planar configuration and extends substantially perpendicular to base 86. An end 92 of leg 88 includes a downwardly extending detent 94 or dimple that is punched or embossed from leg 88. Detent 94 has a substantially frustoconical shape as shown in FIG. 12. Base 62 of lamp assembly 18 includes one or more holes 96 positioned to receive detent 94 as shown in FIG. 13. Preferably, a plurality of adjustment holes 96 are spaced apart around base 62 to define predetermined locations for lamp assembly 18 with respect to ceiling pan 12. In the embodiment illustrated, two springs 82 are attached to ceiling pan 12 on opposite sides of housing 14 and base 62 between two adjacent hold down brackets 28. A hole 96 is provided on opposite sides of base 62 to mate with the respective spring 82.

In one preferred embodiment, alignment holes 96 are provided in base 62 to provide a predetermined factory set position where lamp assembly 18 is oriented such that the lamp is aligned parallel to a side edge of ceiling pan 12. Alignment holes 96 are preferably provided at substantially 90° to each other so that lamp assembly 18 can be aligned in a second position 90° to the first position. Additional holes can also be provided to align lamp assembly 10 at various angles such as, for example, 45° or 30°. The holes 96 are positioned so that detent 94 snaps into a respective alignment hole 96 to provide a visual and tactile sensation of the selected alignment. Springs 82 provide a downward biasing force sufficient to retain lamp assembly 18 in positions during mounting of light assembly 10. The tension applied by springs 82 can be overcome by manually rotating or sliding base 62 to separate the detent of the spring from the respective hole whereby lamp assembly 18 can be moved to a selected position within the limits of the hold down brackets.

In a preferred embodiment of the invention, sight windows 98 are provided in ceiling pan 18 to provide visual orientation of lamp assembly 18 from below after light assembly 10 is installed in the ceiling. Preferably, sight windows 98 are positioned directly below springs 82 so that the respective detent in the springs 82 are visible when received in an alignment hole 96 in base 62. The sight windows 98 on opposite sides of the ceiling pan enable visual alignment of lamp assembly 18 to preset positions.

A locking assembly 100 is provided to lock and fix the position of lamp assembly 18 with respect to ceiling pan 12. Preferably, locking assembly 100 is able to fix the position of the lamp assembly 18 to prevent rotation and lateral movement on ceiling pan 12 after adjusting to the selected position on the ceiling pan. In the embodiment illustrated, two locking assemblies are on opposite sides of base 62.

Figure 15:
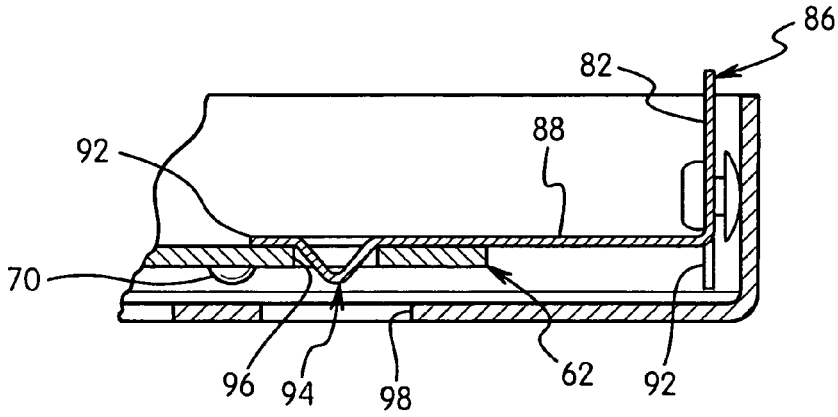
FIG. 15 is an enlarged partial cross-sectional view of the locator spring positioning the base of the lamp assembly.

Locking assembly 100 includes a locking arm 102 and a locking spring 104. Locking arm 102 is pivotally coupled to the top surface of base 62 of lamp assembly 12 in one embodiment of the invention shown in FIGS. 16-23. Locking arm 102 includes a hole 103 at an operating end 106 for receiving pivot pin 108. Operating end 106 has converging flat edges 107 to contact bracket 64 of base 26 to limit pivoting movement of locking arm 102 as shown in FIG. 15. Pivot pin 108 can be riveted as shown that extends through a corresponding hole 110 in base 62. Locking arm 102 has an actuating end 112 with an operating tab 114 for manually moving locking arm 102.

Figure 16:
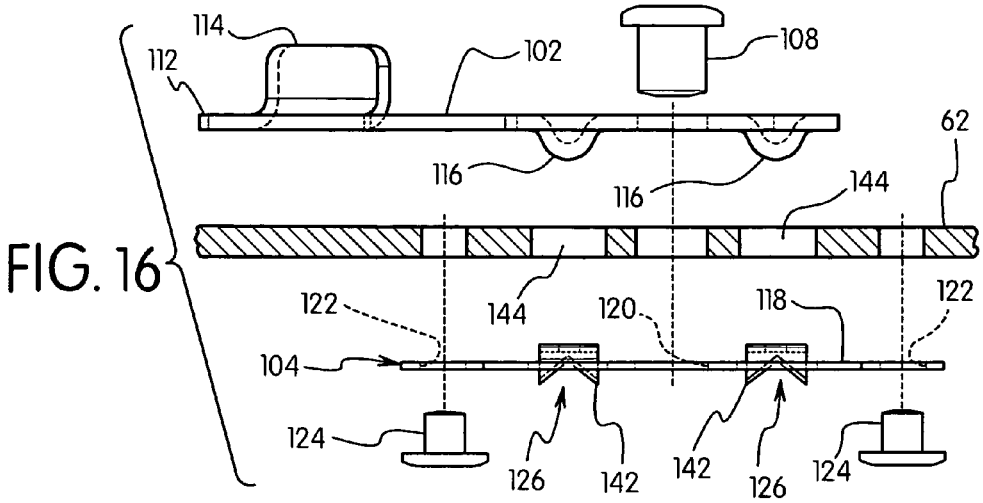
FIG. 16 is an exploded view of the locking assembly.
Figure 17:
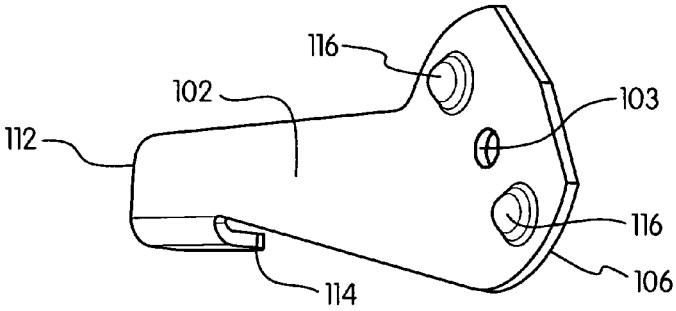
FIG. 17 is a perspective view of the locking arm showing the detents.
Figure 18:
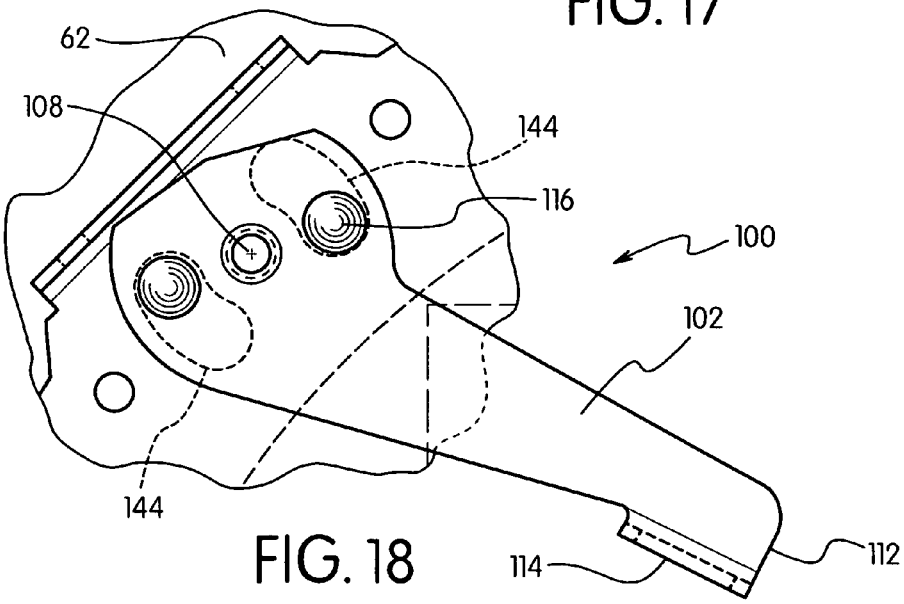
FIG. 18 is a top view of the locking assembly.

Referring to FIGS. 16 and 17, locking arm 102 includes two detents 116 on opposite sides of hole 103 to form a cam surface. As shown in FIGS. 16 and 17, detents 116 are formed by embossed or punched areas and extend outwardly from the bottom face of locking arm 102. Detents 116 typically have a substantially frustoconical shape.

Figure 19:
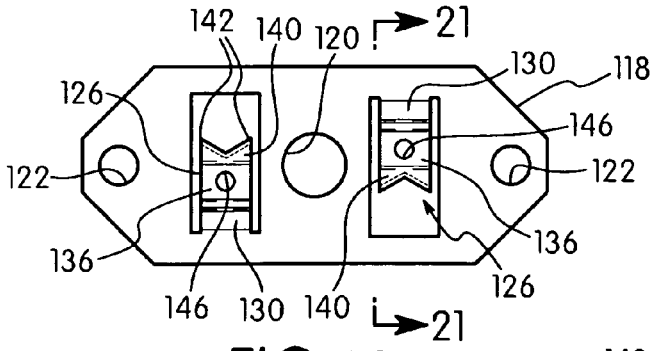
FIG. 19 is a bottom view of the locking plate of the locking assembly.
Figure 20:
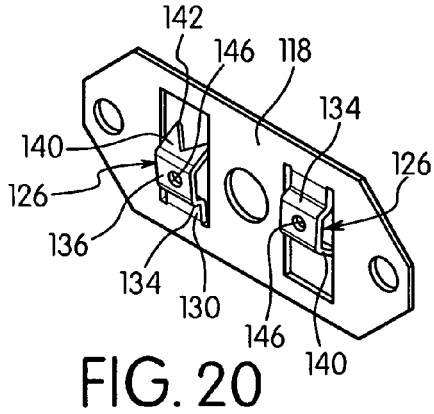
FIG. 20 is a top perspective view of the locking plate showing the locking fingers.
Figure 21:
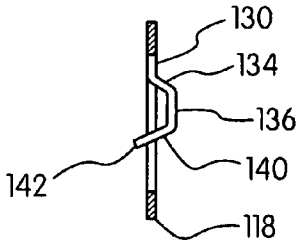
FIG. 21 is a cross-sectional view of the locking plate taken along line 21-21 of FIG. 19.

Locking springs 104 as shown in FIGS. 16, 19 and 20 have a substantially planar base plate 118 that is attached to a bottom side of base 62 of lamp assembly 18. Base plate 118 includes a hole 120 for receiving pivot pin 108 and a pair of mounting holes 122 for receiving fasteners 124 for attaching base plate 118 to the bottom surface of base 62.

Base plate 118 includes two spring arms 126 forming a brake that is cut or punched from base plate 118. Each spring arm 126 is cut from base plate 118 to form an opening 128 where each spring arm 126 is connected to one end of the respective opening 128. Spring arm 126 has a leg 130 extending substantially parallel to the plane of base plate 118 and a substantially U-shaped end portion. The U-shaped portion has a first portion 134 extending upwardly from a top surface of base plate 118, a flat actuating portion 136 parallel to the plane of base plate 118 and a downwardly extending leg 140. Leg 140 has a length to extend from base plate 118 a distance to contact the ceiling pan 12. In the embodiment shown, leg 140 includes teeth 142 for gripping ceiling pan 12.

Figure 22:
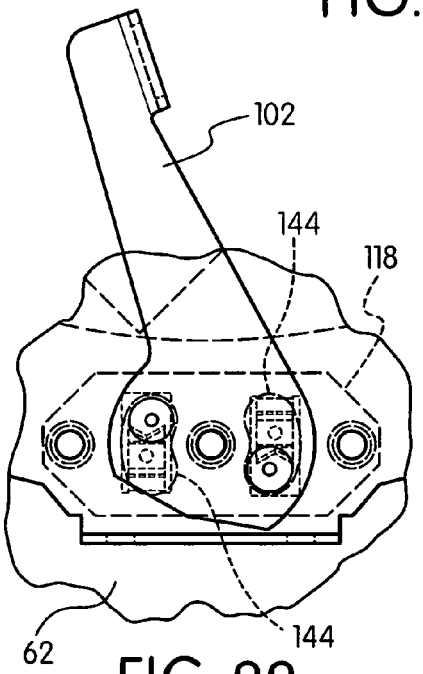
FIG. 22 is a top view of the locking assembly showing the locking arm in the unlocked position.
Figure 23:
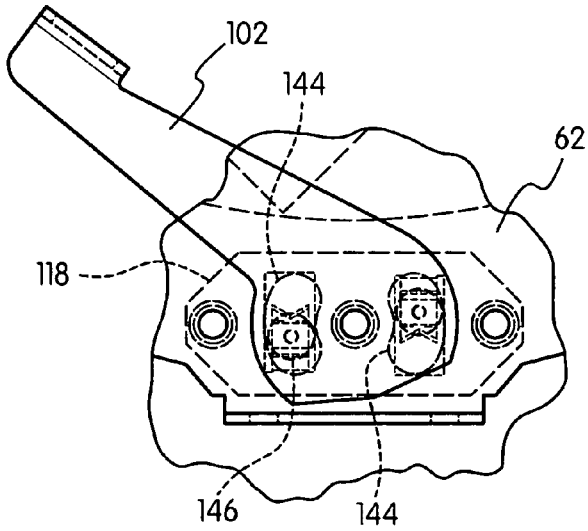
FIG. 23 is a top view showing the locking assembly showing the locking arm in the locked position.

Referring to FIGS. 22 and 23, base 62 of lamp assembly 12 is provided with curved slots 144 on opposite sides of the pivot pin hole. Slots 144 have a dimension to receive detents 116. Slots 144 have a length so that detents 116 slide within the respective slots by the pivotal movement of locking arm 102. The length of slots 144 assist in limiting the pivotal movement of locking arm 102. Base plate 118 of locking spring 104 is attached to the bottom surface of base 62 of lamp assembly 18 with the U-shaped portions 132 extending through the respective slot 144. Locking arm 102 is movable between an unlocking position shown in FIG. 22 to a locking position shown in FIG. 23. In the unlocked position of FIG. 22, detents 116 of locking arm 102 overlie the respective leg 130 so that spring arms 126 are retracted to the position shown in FIG. 22. Leg 130 is normally biased toward base 62 in a retracted position. Locking arm 102 is pivoted to the locking position shown in FIG. 23 where detents 116 engage the U-shaped portion and bend spring arm 126 downwardly. Detents 116 are captured in an aperture 146 in the U-shaped portion to retain locking arm 102 in the locking position. The downward movement of spring arm 126 causes teeth 142 to bite into ceiling pan 12 and push base 62 upward into contact with hold down members 28, thereby wedging base 62 between the hold down members and the bottom wall of ceiling pan 12.

A frame 150 is coupled to bracket 64 of base 62 by screws or rivets. As shown in FIG. 2, base 62 includes upwardly extending brackets 64 for coupling to frame 150. Frame 150 includes two upwardly extending arms 154 and a top wall 156 extending between arms 154 to form a yoke. Arms 154 are coupled to flanges 64 and extend upwardly from base 62. Top wall 156 has a substantially planar shape and is oriented substantially parallel to base 62. Top wall 156 of frame 150 is spaced from base 62 a distance to support the lamp 58 and lamp support 60.

Figure 4:
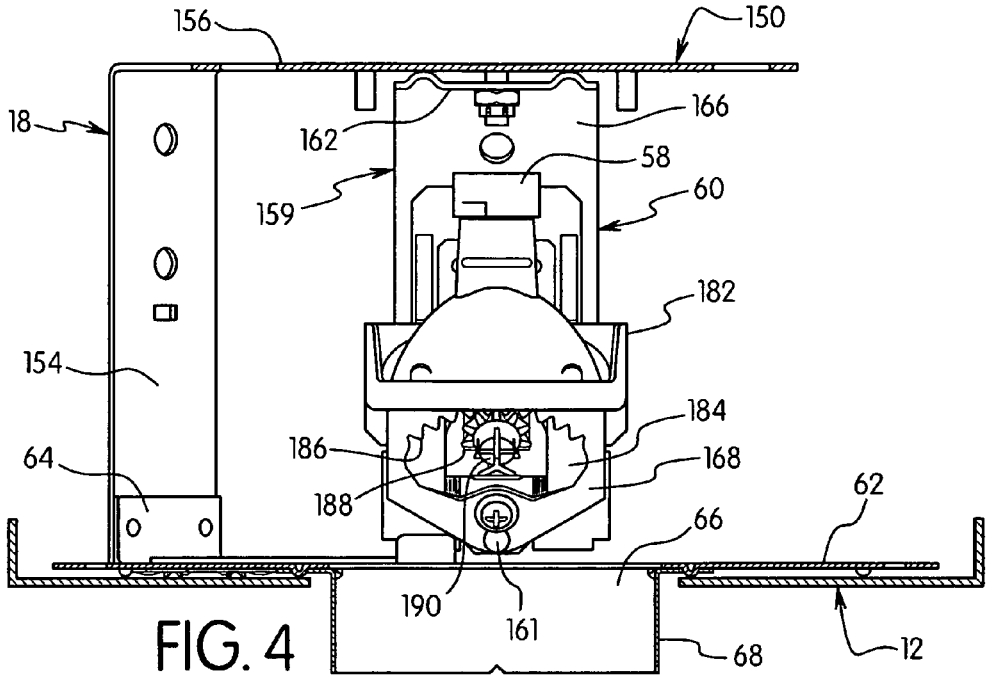
FIG. 4 is an elevational view in partial cross-section of the lighting assembly of FIG. 2.

Lamp support 60 of light assembly 18 includes an adjustment assembly 158 for adjusting the angular position of lamp support 60 and the corresponding lamp 58 as shown in FIGS. 1 and 4. Lamp support 60 in preferred embodiments is pivotally coupled to frame 150 as shown in FIG. 4 by bracket 159. Preferably, lamp support bracket 159 is coupled to top wall 156 of frame 150 by a bolt assembly 160 to enable lamp support bracket 159 to pivot about a vertical axis substantially perpendicular to the plane of base 62. The vertical axis is defined by the normal orientation of the assembly. Lamp support bracket 159 has a top leg 162 having an aperture for receiving the bolt 160 and lies substantially parallel to a bottom surface of top wall 156 of frame 150. Bracket 159 includes a bottom leg 164 which extends in a vertical direction perpendicular to the plane of base 62 and is substantially perpendicular to the plane of top leg 162. In the embodiment illustrated, top leg 162 and bottom leg 164 are connected by an intermediate inclined portion 166. Bottom leg 164 has a bottom end that is spaced above the top surface of base 62 so that lamp support 60 is supported by frame 150 above base 62.

Figure 7:
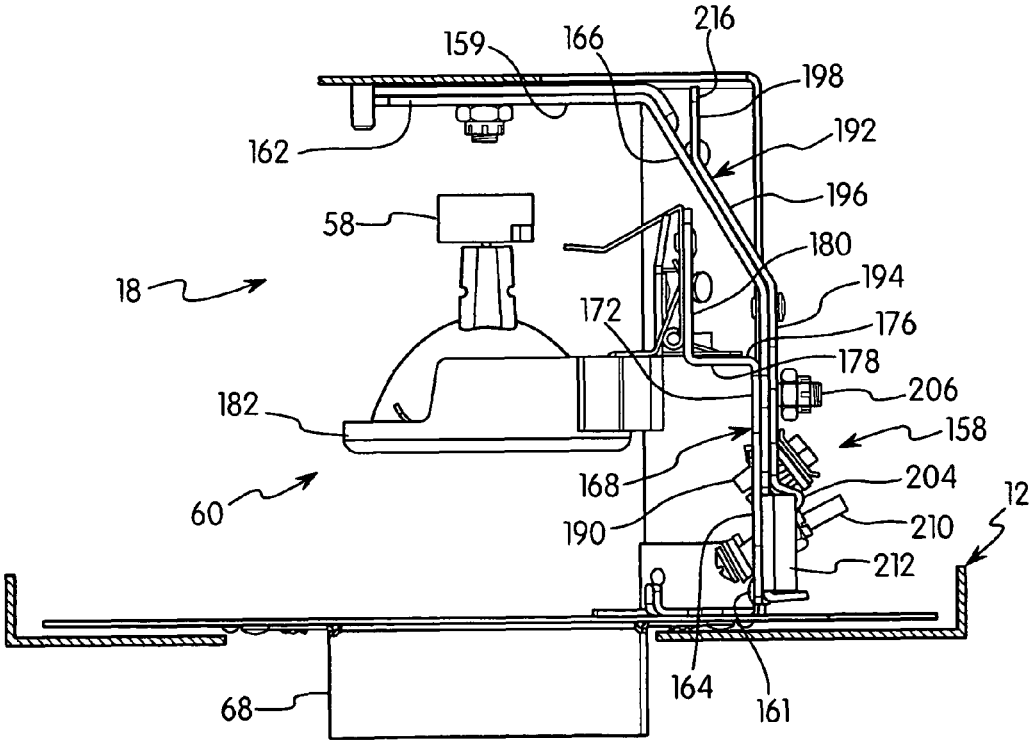
FIG. 7 is a side view of the lamp assembly of FIG. 6.

Referring to FIG. 7, a lamp bracket 168 is coupled to lamp support bracket 159 by a pivot pin 161. Pivot pin 161 is typically a rivet or screw that extends through aligned holes in lamp support bracket 168 and lamp support bracket 159 to enable pivotable movement between the components.

Bracket 168 pivots with respect to lamp support bracket 159 about an axis substantially perpendicular to the axis of rotation of lamp support 60 with respect to frame 152. In preferred embodiments, bracket 168 pivots about a horizontal axis with respect to a longitudinal dimension of the lamp support and the plane of base 62. Bracket 168 pivots to allow angular adjustment of the lamp 58 to direct light through central opening 66 and sleeve 68 in the desired direction.

Bracket 168 as shown in FIG. 7 includes a body having a bottom end with a pivot hole for receiving pivot pin 190. The body has a top end forming an outwardly extending leg 178 and an upwardly extending leg 180. A lamp holder 182 is coupled to upper leg 180 for supporting the lamp 58 as shown in FIGS. 4 and 7. Preferably, lamp holder 182 is coupled to upper leg 180 by rivets or other suitable fasteners.

The body of bracket 168 includes an outwardly extending angled flange having an aperture and an opening 184 shown in FIG. 4. The flange is formed at an incline with respect to the plane of bracket 168. Central opening 184 has a curved top edge with a plurality of teeth 186. Lamp support bracket 159 includes an angled flange with an aperture extending away from an open area. The angled flange of lamp support bracket 159 is aligned with the open area 184 of bracket 168.

A beveled gear 188 is rotatably coupled to the flange of bracket 159 by a fastener such as a bolt 190. Bolt 190 extends through a washer and a spring washer. Bolt 190 is threaded into a threaded hole in the axial end of beveled gear 188 to rotatably mount beveled gear 188 to bracket 159. Beveled gear 188 has a slotted end for receiving a screw driver or other tool for manually rotating beveled gear 188. As shown in FIG. 4, beveled gear 188 meshes with teeth 186 in opening 184 of lamp support lamp support 60. The width of opening 184 which receives beveled gear 188 defines the limits of the angular adjustment of lamp support bracket 168 with respect to lamp support 60 and base 62 of lamp assembly 18.

Lamp support 60 further includes a locking member 192. Locking member 192 has a body 194, an angled portion 196 and an upwardly extending tab 198 corresponding substantially to the shape of lamp support bracket 159. Body 194 and the angled portion overlie the bottom leg and angled portion respectively of lamp support bracket 159 as shown in FIG. 7. Tab 198 extends in an upward direction substantially parallel to body 194.

Figure 6:
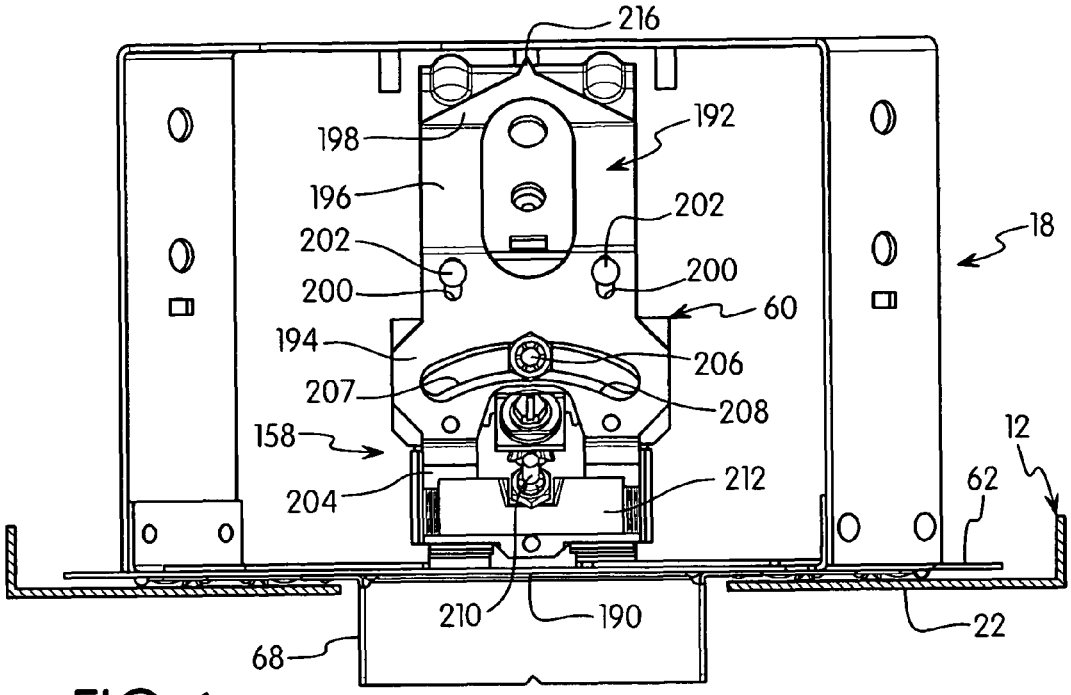
FIG. 6 is an end view of the lamp assembly showing the lamp adjustment assembly.

Referring to FIGS. 6 and 7, body 194 of locking member 192 has two spaced apart elongated slots 200 that are aligned with holes in lamp support bracket 159 which receive rivets 202 or other fasteners. Rivets 202 extend through the holes and slots 200 to allow limited linear movement of locking member 192 with respect to lamp support 60. As shown in FIG. 6, locking member 192 slides in an up and down direction. Rivets 202 preferably have enlarged heads to couple the locking member to lamp support 60.

Body 194 of locking member 192 has an open portion adjacent the bottom end. Body 194 is formed with a bend 204 extending outwardly and forming an inclined cam surface as shown in FIG. 7. A flat bottom portion extends from the cam surface and lies in the plane of body 194.

The body of bracket 168 includes a threaded screw 206 extending outwardly perpendicular to the plane of the body and through a curved arcuate shaped slot 207 in bracket 159 and a curved arcuate slot 208 in locking member 192. A threaded nut is coupled to the end of screw 206 as shown in FIGS. 6 and 7. The curved slots overlie each other and have substantially the same length and pivotal movement of lamp support bracket 168 with respect to lamp support bracket 159 and locking member 192. The curved slot of lamp support bracket 159 has a width corresponding substantially to the outer dimension of screw 206 so that the slot can slide easily on screw 206. Curved slot 208 of locking member 192 has a width greater than the diameter of screw 206 to allow limited linear movement of locking member 192 in the up and down direction.

A locking screw 210 extends through a washer and through the aperture in the angled flange of lamp support bracket 168. A clamping member 212 is coupled to locking screw 210. Clamping member 212 includes an inclined flange with a hole aligned with the aperture in the angled flange of lamp support bracket 168. Locking screw 210 extends through a hole in the flange of clamping member 212. The angled flange is formed with the side edges of clamping member 212 with a dimension corresponding substantially to the outer dimension of the nut. Side portions are spaced apart a distance to substantially prevent rotation of the nut whereby rotation of the screw draws the nut and clamping member toward lamp support bracket 168. Locking screw 210 extends through a hole in the flange and is threaded into a nut to couple clamping member 212 to the assembly.

Referring to FIGS. 1 and 2, top wall 156 of frame 150 includes a plurality of holes 214 arranged in an arcuate path around the pivot point of bracket 159 defined by the nut and bolt 160. As shown in FIG. 3, frame 152 is provided with a plurality of holes 214 arranged in a semi-circular pattern which allow bracket 64 to pivot about 180°. Locking member 192 includes a point 216 extending upwardly from the upper tab for selectively engaging one of the holes 214 to lock bracket 159 with respect to the frame and prevent rotation about the vertical axis. Tightening locking screw 210 forces the top edge of clamping member 212 into engagement with the inclined cam surface of the locking member which urges the locking member in an upward direction so that the point is received in one of the holes to prevent rotational movement of bracket 159 about the vertical axis with respect to the frame. Simultaneously, the clamping force of locking screw prevents rotation of the lamp support bracket about the horizontal axis with respect to bracket 64.

Light assembly 18 is constructed so that the beveled gear and locking screw are accessible through the open end of base 62. During use, the assembly is mounted to a ceiling by the mounting bars. The technician is able to adjust the position of each light assembly 18 through the central opening in base 62 by rotating bracket 64 manually to the desired position. Each of the light assemblies 18 are independently adjustable with respect to each other. A screw driver or other tool can then be inserted through the central opening of base 62 to engage the beveled gear. Rotating beveled gear adjusts the angular position of lamp support bracket with respect to bracket 64. After lamp support bracket is adjusted to the desired position, the locking screw is tightened using a suitable tool to lock the assembly in place.

While various embodiments have been described and shown in the drawings, it will be understood by one skilled in the art that various changes and modifications can be made without departing from the scope of the invention as defined in the appended claims.

What is claimed is:

1. A light assembly comprising:

a ceiling pan adapted for attaching to a ceiling, said ceiling pan having an opening for directing light in a downward direction; and a lamp assembly mounted on said ceiling pan, said lamp assembly having a substantially planar base having an opening, a lamp support coupled to said base, and a lamp coupled to said lamp support for directing light in a substantially downward direction through said opening in said base and said ceiling pan, said base being coupled to said pan for limited rotational movement about a vertical axis with respect to said ceiling pan and for limited linear transverse movement with respect to said ceiling pan and said opening in said ceiling pan in a linear direction parallel to a plane of said pan and substantially perpendicular to said vertical axis; and a locking assembly including a locking arm pivotally coupled to said base and having a cam surface for engaging a locking spring, said locking spring having an end for engaging said ceiling pan.

2. The lighting assembly of claim 1, further comprising a plurality of spaced-apart hold down members coupled to said ceiling pan, each of said hold down members having an end overlying a top surface of said planar base of said lamp assembly.

3. The lighting assembly of claim 2, wherein said locking spring is movable between a retracted position and an extended locking position to engage said ceiling pan and move said base away from said ceiling pan and into contact with said hold down members.

4. The lighting assembly of claim 3, wherein said locking spring has a detent for engaging said cam surface.

5. The lighting assembly of claim 2, further comprising a spring member coupled to said base and having a leg overlying said base, said leg having a detent extending toward said base, said base having a plurality of adjustment holes for receiving said detent for positioning said base in a selected position corresponding to locations of said adjustment holes.

6. The lighting assembly of claim 1, said ceiling pan further comprising a stop member coupled to said ceiling pan for engaging said lamp assembly for limiting rotational movement and transverse movement of said base of said lamp assembly with respect to said ceiling pan.

7. The lighting assembly of claim 6, wherein said base includes an aperture for receiving said stop member.

8. The lighting assembly of claim 7, wherein said stop member is a pin extending upwardly through said aperture and being fixed to said ceiling pan, said aperture having a dimension greater than a dimension of said pin to limit rotational and transverse movement of said lamp assembly with respect to said ceiling pan.

9. The lighting assembly of claim 6, wherein said lamp support is adjustable about a vertical axis and about a horizontal axis with respect to said base to direct the light through said opening in said base and said ceiling pan to a target area.

10. The lighting assembly of claim 1, wherein said base of said lamp assembly has a downwardly extending sleeve, said sleeve extending through said opening in said ceiling pan and having a dimension less than said opening to allow transverse adjustment of said base and lamp assembly with respect to said ceiling pan.

11. A lighting assembly comprising:

a ceiling pan for coupling to a support, said ceiling pan having a substantially planar bottom wall and having an opening extending therethrough;

at least one hold down member on a top surface of said ceiling pan;

a lamp assembly having a substantially planar base secured to said ceiling pan by said at least one hold down member, said hold down member overlying a top surface of said base, said base having an opening aligned with said opening in said ceiling pan, and a lamp coupled to said base and for directing light downwardly through said opening in said ceiling pan and said opening in said base of said lamp assembly, said base of said lamp assembly being rotatably movable with respect to said ceiling pan about an axis substantially perpendicular to a plane of said ceiling pan and said base being transversely movable with respect to said ceiling pan in a direction substantially parallel to said plane of said ceiling pan; and a stop assembly fixed on said ceiling pan for limiting the rotational movement and transverse movement of said base of said lamp assembly with respect to said ceiling pan, said stop member extending upwardly from and fixed to said bottom wall of said ceiling pan, and where said planar base of said lamp assembly includes an aperture for receiving said stop member whereby said stop member extends through said aperture, said aperture having a dimension greater than a diameter of said stop member to allow limited transverse and rotational movement of said base of said lamp assembly with respect to said ceiling pan and said stop member when said stop member is engaged with the aperture.

12. The lighting assembly of claim 11, further comprising a plurality of said hold down members spaced apart around said opening in said ceiling pan, each of said hold down members having an end overlying said base and being spaced apart a distance sufficient to allow limited transverse movement of said base between said hold down members with respect to said ceiling pan.

13. The lighting assembly of claim 11, wherein said base of said lamp assembly has a plurality of glide members between said base and said bottom wall of said ceiling pan.

14. The lighting assembly of claim 13, wherein said glide members extend downwardly from said base.

15. The lighting assembly of claim 13, wherein said glide members are detents extending downwardly from a bottom surface of said base and are integrally formed with said base.

16. A lighting assembly comprising:

a ceiling pan for coupling to a support, said ceiling pan having a substantially planar bottom wall and having an opening extending therethrough, said ceiling pan having a sight window in said bottom wall and spaced from said opening in said ceiling pan;

at least one hold down member on a top surface of said ceiling pan;

a lamp assembly having a substantially planar base secured to said ceiling pan by said at least one hold down member, said hold down member overlying a top surface of said base, said base having an opening aligned with said opening in said ceiling pan, and a lamp coupled to said base and for directing light downwardly through said opening in said ceiling pan and said opening in said base of said lamp assembly, said base of said lamp assembly being rotatably movable with respect to said ceiling pan about an axis substantially perpendicular to a plane of said ceiling pan and said base being transversely movable with respect to said ceiling pan in a direction substantially parallel to said plane of said ceiling pan; and said base of said lamp assembly includes an indicator aligned with said sight window that is visible through said sight window for visually aligning said lamp assembly when said lamp assembly is in a predetermined position and where said indicator is spaced from said opening in said base, and a stop assembly fixed on said ceiling pan for limiting the rotational movement and transverse movement of said base of said lamp assembly with respect to said ceiling pan.

17. The lighting assembly of claim 16, further comprising a spring member overlying said base and having a downwardly extending detent; and wherein said indicator is an aperture in said base with a dimension to receive said detent to hold said lamp assembly in said predetermined position.

18. A lighting assembly comprising:

a ceiling pan having a top surface, a bottom surface, and a centrally located opening for directing light in a substantially downward direction;

a lamp assembly on said top surface of said ceiling pan, said lamp assembly having a substantially planar base contacting said top surface of said ceiling pan, a lamp support coupled to said base; and a locking assembly for locking said base of said lamp assembly in a fixed position with respect to said pan, said locking assembly including a pivoting locking arm directly attached to and pivotally coupled to a top surface of said base of said lamp assembly, and a brake member coupled to a bottom surface of said base of said lamp assembly for contacting said ceiling pan and preventing movement of said base of said lamp assembly with respect to said ceiling pan, said brake member being actuated by pivotal movement of said locking arm, wherein said pivotal movement of said locking arm is in a plane substantially parallel to said ceiling pan.

19. The lighting assembly of claim 18, wherein said locking arm includes a cam member extending through a slot in said base for engaging said brake member for moving said brake member away from said base into engagement with said ceiling pan and moving said base away from said ceiling pan into engagement with a plurality of hold down members on said ceiling pan, wherein said plurality of hold down members overlie said base.

20. The lighting assembly of claim 19, wherein said brake member is a spring having a first end coupled to said base and a second free end for engaging said ceiling pan, and where said spring has a detent between said first and second ends for engaging said cam member on said locking arm.

21. The lighting assembly of claim 18, wherein said base of said lamp assembly is movable in a linear transverse direction substantially parallel to a plane of said top surface of said ceiling pan and rotatable about an axis perpendicular to a plane of said base.

22. The lighting assembly of claim 21, wherein said base of said lamp assembly has an aperture, and said ceiling pan has a stop member extending upwardly from said top surface and extending through said aperture and having a diameter less than a diameter of said aperture to limit the transverse movement of said lamp assembly with respect to said ceiling pan.

* * * * *